United States Patent [19]

Hayes

[11] 4,203,552

[45] May 20, 1980

[54] PRESSURIZED ATOMIZER

[75] Inventor: Thomas H. Hayes, Baton Rouge, La.

[73] Assignee: Ethyl Corporation, Richmond, Va.

[21] Appl. No.: 939,276

[22] Filed: Sep. 5, 1978

[51] Int. Cl.[2] ..... B05B 3/10

[52] U.S. Cl. ..... 239/337

[58] Field of Search ..... 239/337, 338, 358, 312, 239/318, 418, 566, 421, 433, 416, 434; 261/78 A, 115; 222/193

[56] References Cited

U.S. PATENT DOCUMENTS

| | | | |
|---|---|---|---|
| 3,437,272 | 4/1969 | Abplanalp | 239/338 |
| 3,584,792 | 6/1971 | Johnson | 239/338 |
| 4,141,472 | 2/1979 | Spitzer et al. | 239/337 |

*Primary Examiner*—James B. Marbert

*Attorney, Agent, or Firm*—Donald L. Johnson; John F. Sieberth; David L. Ray

[57] ABSTRACT

An apparatus for dispensing liquid including a container for storing liquid, a closure connected to the container, a gas reservoir connected to the closure for supplying gas under pressure to the interior of the container, a stem slidably connected to the gas reservoir for controlling the flow of gas from the reservoir, a dip tube connected to the stem for conveying liquid from the container to the stem, a cap connected to the closure having an orifice therein, and a film forming post connected to the closure with an orifice therein aligned with the orifice in the cap.

15 Claims, 7 Drawing Figures

PRESSURIZED ATOMIZER

BACKGROUND OF THE INVENTION

This invention relates to aerosol dispensers and, more particularly, to such dispensers wherein a liquid spray is discharged from the dispenser by a propellant gas when a valve on the aerosol dispenser is actuated.

Aerosol dispensers are utilized for packaging and dispensing a wide variety of liquids. When the dispensing valve is actuated by depressing the stem of the valve extending outwardly from the top of the dispenser, the liquid is sprayed out of the dispenser through an orifice in the valve stem. The liquid is discharged through and out of the orifice in a spray pattern.

With some materials such as quick drying hair sprays, the uniformity of the spray pattern and the size of the liquid particles in the pattern sprayed are of particular importance. Variation in the pattern and variations in the size of the liquid particles during the time when the contents of the dispenser are being used can adversely effect the spray application of the liquid and the effectiveness of such liquid.

Various attempts have been made to improve the spray pattern and uniformity of the particle size of the liquid sprayed from aerosol dispensers. Such attempts have included arrangements in the valves, the orifices, and the internal diameter of the dip tube.

Exemplary methods for converting liquid into fine spray are those disclosed in U.S. Pat. No. 3,421,692 and U.S. Pat. No. 3,421,699, which are hereby incorporated by reference. In these patents, liquid is introduced onto a smooth surface having an aperture therethrough which causes the liquid to "film out" on the surface either by surface tension or by the shape of the surface so that the liquid is under stress before it reaches the aperture. The film flows over the aperture through which a gaseous dispensing medium is discharged to create minuscle particles of the thin liquid film to form a fine particle spray.

SUMMARY OF THE INVENTION

In accordance with the invention, there is provided an apparatus for dispensing liquid including a container for storing liquid, a closure connected to the container, a gas reservoir connected to the closure for supplying gas under pressure to the interior of the container, a stem slidably connected to the gas reservoir for controlling the flow of gas from the reservoir, a dip tube connected to the stem for conveying liquid from the container to the stem, a cap connected to the closure of the cap having an orifice therein, and a film forming post connected to the closure with an orifice aligned with the orifice in the cap.

DESCRIPTION OF THE PREFERRED EMBODIMENTS

Figure 2:
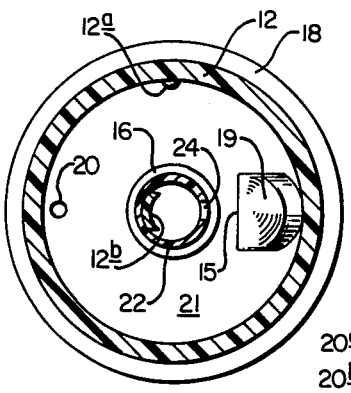
FIG. 2 is a cross-sectional view taken along lines 2—2 of FIG. 1.
Figure 1:
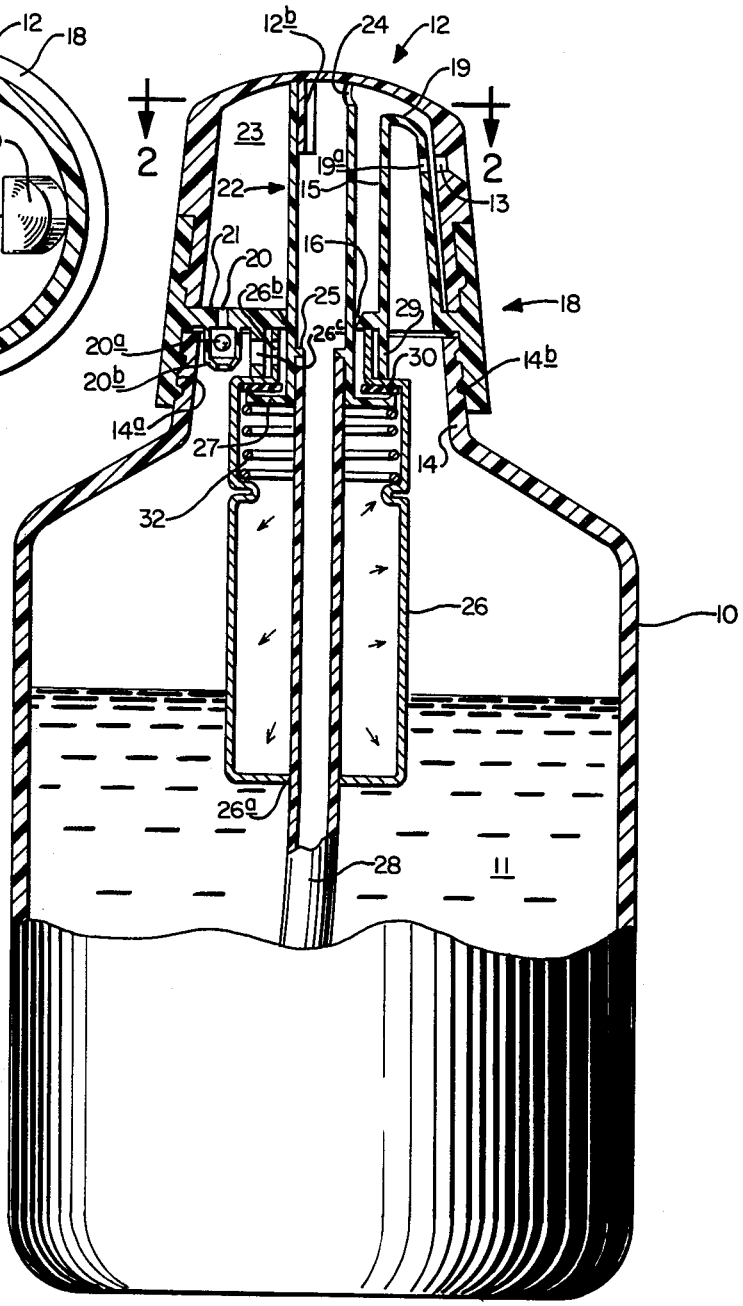
FIG. 1 is a partly cross-sectional, partly cut-away view of one embodiment of the present invention.
Figure 3:
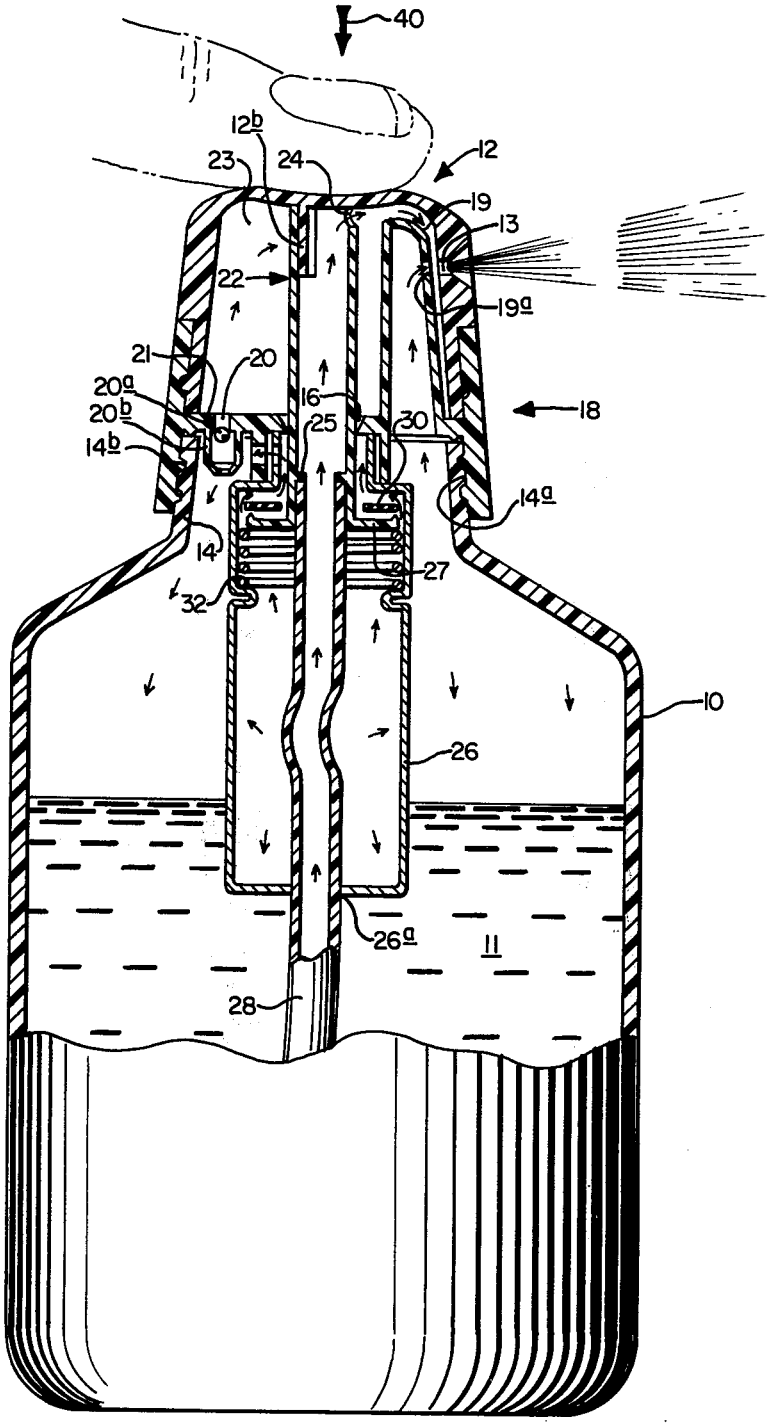
FIG. 3 is a partly cross-sectional, partly cut-away view of the dispenser of FIG. 1 wherein liquids are being dispensed therefrom.

Referring now to FIGS 1-3, the liquid 11 to be dispensed can be seen to be held in container 10 which has an upper portion 14 for receipt of closure 18. The upper portion 14 of container 10 has threads **14*a* which engage threads 14*b* on closure 18 to secure closure 18 to container 10. As is well known in the art, container 10 may be formed without threads and closure 18** affixed thereto by gluing, snapping, or the like.

Closure 18 has a flat, circular floor portion 21. Located above floor 21 is chamber 23. Floor 21 has a hole 20 therein through which liquids from chamber 23 may drain into container 10. Collar 29 extends downwardly from floor 21 of closure 18 and contains hole **26*c*. Hole 26*c* is axially aligned with hole 26*b*. Collar 29 facilitates holding reservoir 26** in place.

Extending upwardly from floor 21 is film forming post 15. Post 15 has an upper surface 19 onto which liquids are directed to form a thin film. The thin film formed on upper surface 19 passes over orifice **19*a* and post 15**.

The upper surface 19 of post 15 must be sufficiently smooth so that a film of liquid may be formed thereover, and the point of application of the liquid must be a distance sufficient from the aperture **19*a*** to permit formation of the film before the liquid passes over the aperture. This has been explained in U.S. Pat. No. 3,421,692 and U.S. Pat. No. 3,421,699.

The shape and contour of the aperture has an effect on spray uniformity and capacity, and aperture or orifice **19*a* is preferably round in shape. Also, the walls of the aperture can be parallel or diverge outwardly toward the upper surface 19 of post 15. As shown in the drawings, the aperture 19*a*** is simply a round hole having a straight-through circumferential wall.

Stem 22 is shown located in round hole 16 of closure 18. Stem 22 can be seen to have an opening 24 in the upper end thereof for directing liquids toward the upper surface 19 of post 15, as indicated by the arrow in FIG. 3.

Stem 22 is generally circular in cross-section and has an inner flange 25 at the lower end thereof against which is fitted dip tube 28. At the extreme lower end of stem 22 is flange 27 which fits inside of pressurized gas reservoir 26.

Gas reservoir 26 may contain any desired gas under pressure. The preferred gas is carbon dioxide.

Gas reservoir 26 has dip tube 28 running therethrough. Dip tube 28 is rigidly sealed to reservoir 26 at the bottom **26*a* thereof to prevent pressure from escaping around the dip tube to the atmosphere. Dip tube 28 is flexible and bends when stem 22** is depressed as shown in FIG. 3.

Also located in the interior of reservoir 26 is spring 32 which presses against flange 27 to force flange 27 upwardly against gasket 30 to effect a pressure seal at the top of reservoir 26. Reservoir 26 has a hole in the upper end thereof, **26*b*, through which pressurized gas can flow when stem 22** is depressed.

Located at the upper end and attached to closure 18 is cap 12 having exit orifice 13 therein. Cap 12 is shown snapped to the interior of closure 18 to hold the cap 12 in place on closure 18. Cap 18 can rotate about closure 18 when snapped in place as shown in FIG. 1. However, if desired, threads may be provided on the interior of closure 18 and on the exterior of cap 12 so that cap 12 can be threaded into closure 18.

Cap 12 may include a tab 12a on the interior wall thereof for sealing orifice 19a. To seal orifice 19a, cap 12 is rotated so that tab 12a is aligned over orifice 19a thus preventing any leakage of liquids from orifice 19a when the container is inverted.

To prevent fluids from leaking through drain hole 20 when the container is inverted, a conventional ball check valve 20a contained in housing 20b may be used to seal orifice 20 to prevent leakage when the container 10 is inverted or, when liquids are being dispensed, to conserve the amount of gas consumed.

At the upper end of cap 12 is tab 12b. Tab 12b fits inside of stem 22 to aid in aligning stem 22 in proper position with respect to cap 12 and to hold stem 22 in place.

In FIG. 3 is illustrated the manner in which the embodiment shown in FIGS. 1–3 functions. When stem 22 is depressed downwardly above the finger shown in FIG. 3, flange 27 at the lower end of stem 22 moves downwardly away from gasket 30. Pressurized gas contained in the interior of reservoir 26 then escapes around gasket 30 and outwardly through holes 26b and 26c as indicated by the arrows. Thus, the interior of container 10 above liquid 11 is pressurized with gas escaping from reservoir 26 as is chamber 23.

Due to the increased pressure within container 10, liquids are forced upwardly through the bottom of dip tube 28 and outwardly through opening 24. As the liquids exit through opening 24, they strike the upper surface 19 of post 15. Due partly to the velocity of the liquid, and the smooth curved surface of 19, a thin film is formed on surface 19 downward to orifice 19a.

Gas under pressure in the interior of container 10 travels upward into the interior of post 15 as indicated by the arrow. The gas then exits outwardly through orifice 19a and post 15. As it exits through orifice 19a it strikes the thin film of liquid on the outer surface 19 of post 15 causing minuscle particles of liquid to break away from the film to produce a very fine uniform spray. The uniform spray continues outwardly through orifice 13 in cap 12.

Pressurized gas in the interior of container 10 also travels upwardly through hole 20 into chamber 23. However, gas in chamber 23 does not then travel over and around post 15 and outwardly through orifice 13 because ball check valve 20a in housing 20b seals hole 20.

Figures 4, 5:
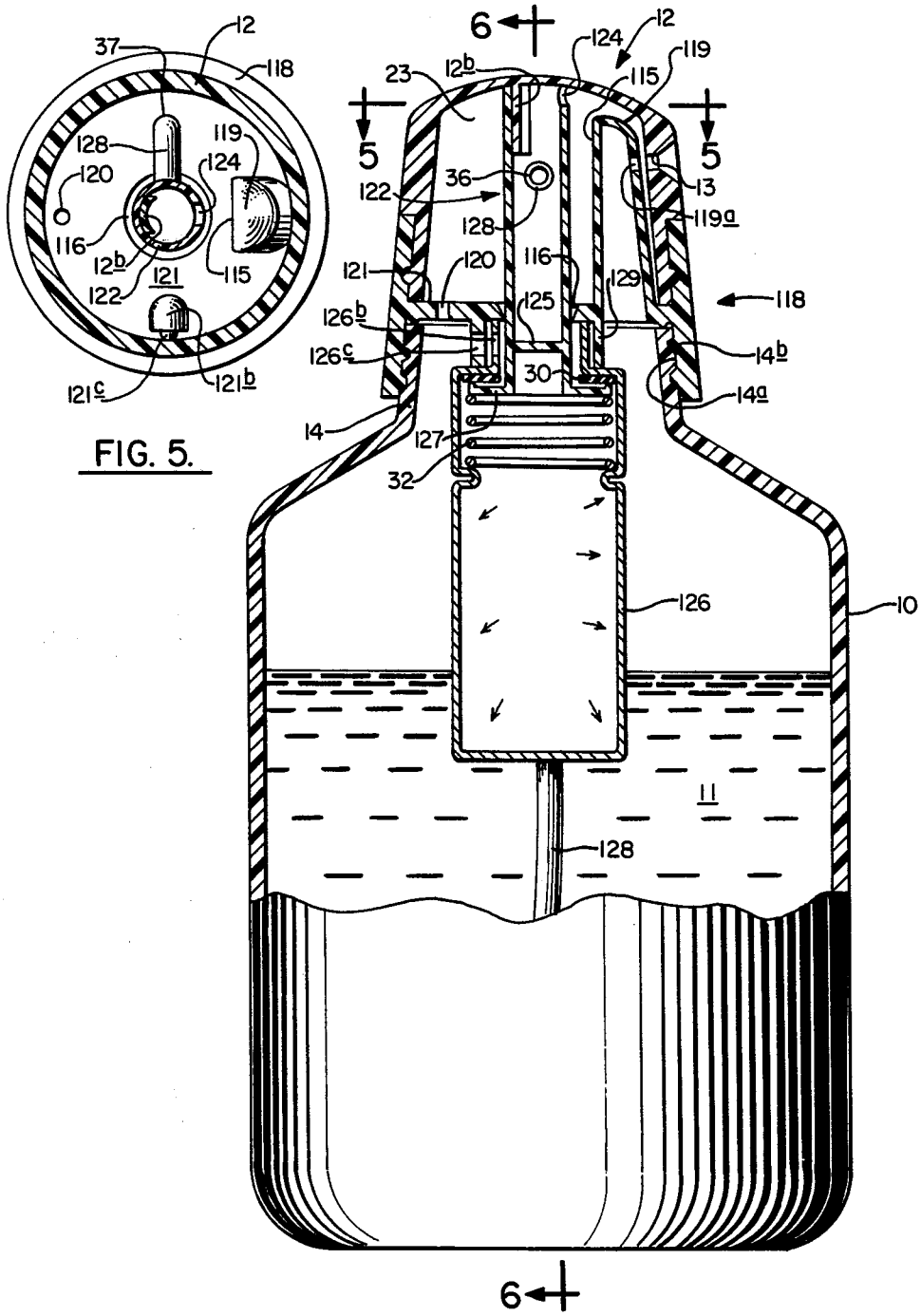
FIG. 4 is a partly cross-sectional, partly cut-away view of an alternate embodiment of the present invention.
FIG. 5 is a cross-sectional view taken along lines 5—5 of FIG. 4.
Figure 6:
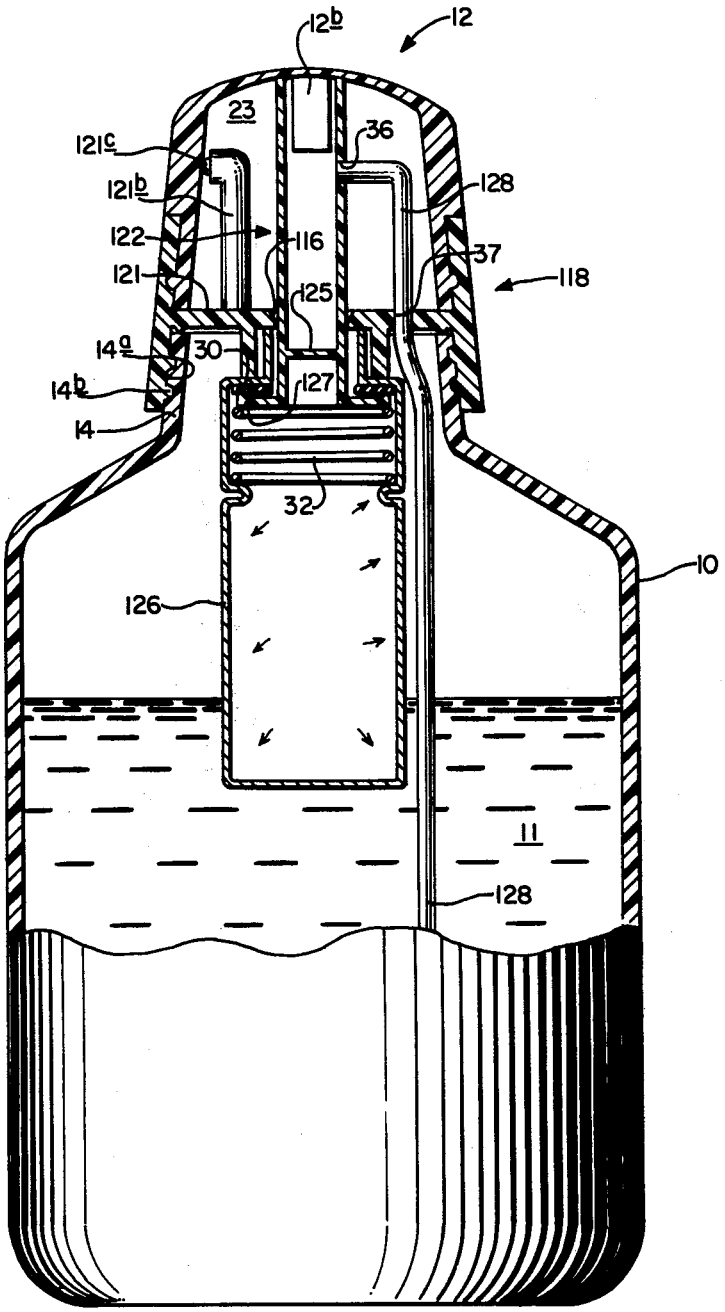
FIG. 6 is a partly cross-sectional, partly cut-away view taken along lines 6—6 of FIG. 4.
Figure 7:
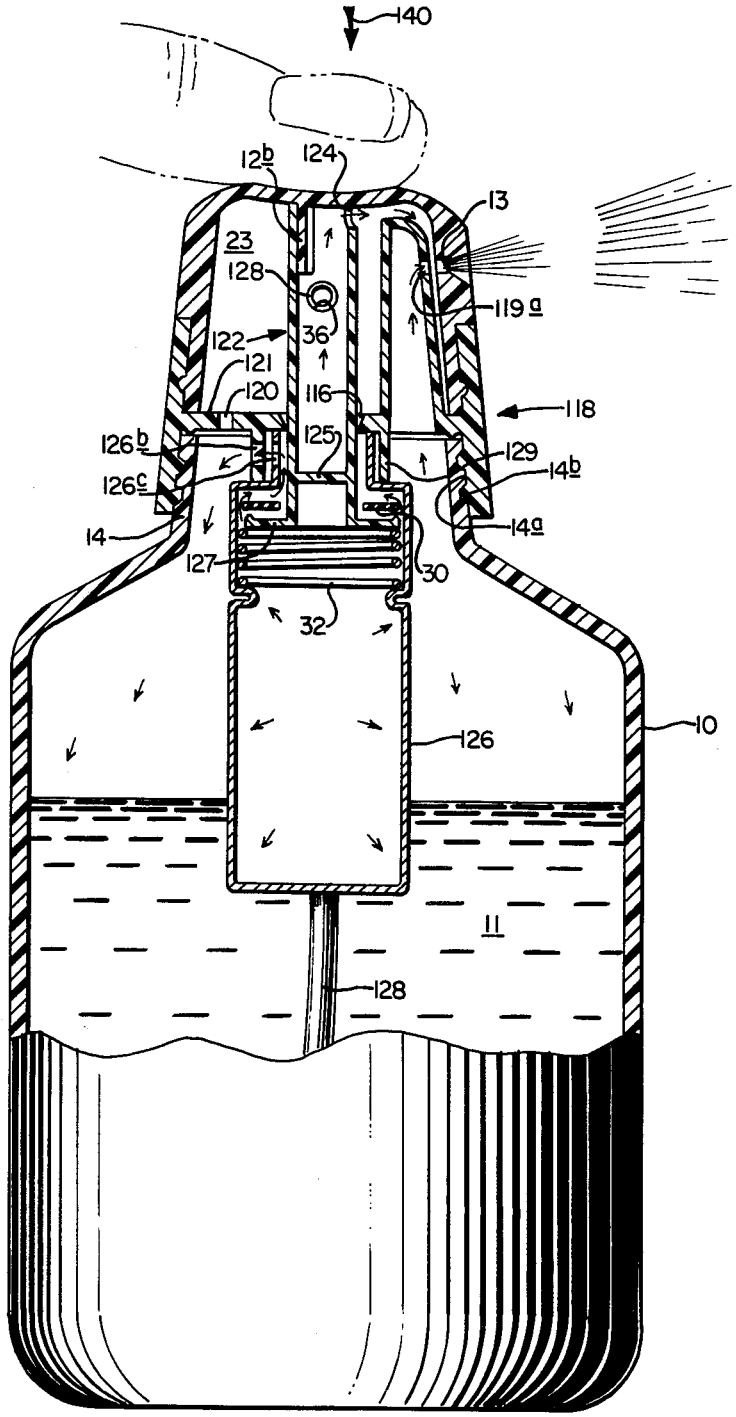
FIG. 7 is a partly cross-sectional, partly cut-away view of the embodiment of FIG. 4 wherein liquids are being dispensed therefrom.

Referring now to FIGS. 4–6, an alternate embodiment of the invention can be seen to differ primarily in the location of the dip tube 128. Instead of dip tube 128 extending upwardly through the center of gas reservoir 126, dip tube 128 extends upwardly from the liquid 11 in container 10 through holes 37 in the floor 121 of closure 118 to hole 36 in stem 122.

As seen in FIGS. 4–6, the liquid 11 to be dispensed can be seen to be held in container 10 which has an upper portion 14 for receipt of closure 118. The upper portion 14 of container 10 has threads 14a which engage threads 14b on closure 118 to secure closure 118 to container 10. As is well known in the art, container 10 may be formed without threads and closure 118 affixed thereto by gluing, snapping, or the like.

Closure 118 has a flat, circular floor portion 121. Located above floor 121 is chamber 23. Floor 121 has a hole 120 therein through which liquids from chamber 23 may drain into container 10 and a hole 37 through whic dip tube 128 estends. Collar 129 extends downwardly from floor 121 of closure 118 and contains hole 126c. Hole 126c is axially aligned with hole 126b. Collar 129 facilitates holding reservoir 126 in place.

Extending upwardly from floor 121 is film forming post 115. Post 115 has an upper surface 119 onto which liquids are directed to form a thin film. The thin film formed on upper surface 119 passes over orifice 119a and post 115.

The upper surface 119 of post 115 must be sufficiently smooth so that a film of liquid may be formed thereover, and the point of application of the liquid must be a distance sufficient from the aperture 119a to permit formation of the film before the liquid passes over the aperture. This has been explained in U.S. Pat. No. 3,421,692 and U.S. Pat. No. 3,421,699.

The shape and contour of the aperture has an effect on spray uniformity and capacity, and aperture or orifice 119a is preferably round in shape. Also, the walls of the aperture can be parallel or diverge outwardly toward the upper surface 119 of post 115. As shown in the drawings, the aperture 119a is simply a round hole having a straight-through circumferential wall.

Stem 122 is shown located in round hole 116 of closure 118. Stem 122 can be seen to have an opening 124 in the upper end thereof for directing liquids toward the upper surface 119 of post 115, as indicated by the arrows in FIG. 6.

Stem 122 is generally circular in cross-section and is closed by flange 125 at the lower end thereof. At the extreme lower end of stem 122 is flange 127 which fits inside of pressurized gas reservoir 126.

Gas reservoir 126 may contain any desired gas under pressure. The preferred gas is carbon dioxide.

Dip tube 128 is rigidly sealed to stem 122 at hole 36 and extends through floor 121 at hole 37. Dip tube 128 is flexible and bends when stem 122 is depressed. If desired, the portion of dip tube 128 between hole 37 and hole 36 could be replaced with a flexible tube (not shown) for conveying liquids from hole 37, and dip tube 128 could be shortened to extend from hole 37 to the bottom of container 10.

Also located in the interior of reservoir 126 is spring 32 which presses against flange 127 to force flange 127 upwardly against gasket 30 to effect a pressure seal at the top of reservoir 126. Reservoir 126 has a hole in the upper end thereof, 126b, through which pressurized gas can flor when stem 122 is depressed.

Located at the upper end and attached to closure 118 is cap 12 having exit orifice 13 therein. Cap 12 is shown snapped to the interior of closure 118 to hold the cap 12 in place on closure 118. However, if desired, threads may be provided on the interior of closure 118 and on the exterior of cap 12 so that cap 12 can be threaded into closure 118.

As shown in FIGS. 5 and 6, extending upwardly from floor 121 is a post 121b having a slight protuberance 121c extending therefrom. Post 121b is used to seal orifice 13 in cap 12. When cap 12 is rotated over post 121b and the protuberance 121c is nested inside orifice 13, no liquids can flow from orifice 13 when the container 10 is inverted or evaporate during storage.

It will be understood that the check valve 20*a* and tab 12*a* shown in FIGS. 1–3 may be used in place of post 121 on the embodiment shown in FIGS. 4–7 and that the post 121 may be used on the embodiment shown in FIGS. 1–3 rather than tab 12*a* and check valve 20*a*. Thus, both methods for sealing the container may be used on either embodiment.

At the upper end of cap 12 is tab 12*b*. Tab 12*b* fits inside of stem 122 is aid in aligning stem 122 in proper position with respect to cap 12 and to hold stem 122 in place.

In FIG. 6 is illustrated the manner in which the embodiment shown in FIGS. 4–6 functions. Whem stem 122 is depressed downwardly in the direction indicated by the arrow 140 which is immediately above the finger shown in FIG. 6, flange 127 at the lower end of stem 122 moves downwardly away from gasket 30. Pressurized gas contained in the interior of reservoir 126 then escapes around gasket 30 and outwardly through holes 126*b* and 126*c* as indicated by the arrows. Thus, the interior of container 10 above liquid 11 is pressurized with gas escaping from reservoir 126 as in chamber 23.

Due to the increased pressure within container 10, liquids are forced outwardly through the bottom of dip tube 128, into stem 122, and outwardly through opening 124. As the liquids exit through opening 124, they strike the upper surfaces 119 on post 115. Due partly to the velocity of the liquid, and the smooth curved surface of 119, a thin film is formed on surface 119 downward to orifice 119*a*.

Gas under pressure in the interior of container 10 travels upwardly into the interior of post 115 as indicated by the arrows. The gas then exits outwardly through orifice 119*a* and post 115. As it exits through orifice 119*a*, it strikes the thin film of liquid on the outer surface 119 of post 115 causing minuscle particles of liquid to break away from the film to produce a very fine uniform spray. The uniform spray continues outwardly through orifice 13 in cap 12.

Pressurized gas in the interior of container 10 also travels upwardly through hole 120 into chamber 23. Gas in chamber 23 then travels over and around post 115 and outwardly through orifice 13. The gas flowing outwardly through orifice 13 from chamber 23 further aids in achieving a very fine uniform spray.

All parts of the invention can be made from conventional plastic materials. The gas reservoir is preferably made from a metal. The cap 12 should be made from a material which can be easily flexed downward by the finger of the user.

If desired, any conventional means well known in the art may be added to the disclosed structure to prevent the stem from being susceptible of depression when in a locked position. Such structures are well known in the art and could include a cam mechanism responsive to rotation of the cap.

While the various embodiments illustrated all incorporate a smooth surface having a slight curvature, it should be clearly understood that satisfactory results can be produced where the surface 19 or 119 lies in a single plane so long as the kinetic energy of the liquid as applied to the surface is sufficient to cause the liquid to "film out" before it passes over the point at which the aperture or orifice on post 15 or 115 is located. This principle has been explained in U.S. Pat. No. 3,421,692 and U.S. Pat. No. 3,421,699.

It is thought that the invention and many of its attendant advantages will be understood from the foregoing description and it will be apparent that various changes may be made in the form, construction, and arrangement of the parts without departing from the spirit and scope of the invention, the forms hereinbefore described being merely preferred embodiments thereof.

I claim:

1. An apparatus for dispensing liquids, comprising:

a. container means for storing said liquids;

b. closure means connectable to said container means, said closure means having a floor means defining an upper chamber means between the interior of cap means and said floor means, said floor means having a hole therein for allowing liquids contained in said upper chamber means to drain downwardly into said container means;

c. gas reservoir means connected to said closure means for supplying gas under pressure to the interior of said container;

d. dip tube means for conveying liquid from said container to said stem means;

e. cap means connected to said closure means, said cap means having first orifice means therein;

f. film forming means connected to said floor of said closure means, said film forming means comprising post means having second orifice means therein alignable with said first orifice means, said post means having a hollow chamber therein which communicates with the interior of said container through said floor of said closure; and, g. stem means slidably connected to said gas reservoir means for controlling the flow of gas from said reservoir, said stem means having third orifice means therein for directing liquids onto said post means, said stem means extending through said floor means and into said chamber means.

2. The apparatus of claim 1 wherein said post means is connected to said closure means.

3. The apparatus of claim 2 wherein said post means is contained within said cap means.

4. The apparatus of claim 3 wherein said post means has a curved exterior surface over which said liquid flow prior to said liquids reaching said second orifice means.

5. The apparatus of claim 1 wherein said dip tube means extends into said gas reservoir means.

6. The apparatus of claim 5 wherein said gas reservoir means has a top end to which said stem means is connected and a bottom end through which said dip tube means extends, said dip tube means being sealed to said reservoir means at said bottom end to prevent gas from said reservoir means escaping around said dip tube means.

7. The apparatus of claim 6 wherein said dip tube means is connected to the lower end of said stem means.

8. The apparatus of claim 7 wherein said floor means has check valve means connected thereto beneath said hole in said floor means for sealing said hole when said container is inverted to prevent liquids from flowing from said container into said upper chamber means when said container is inverted.

9. The apparatus of claim 8 wherein said cap means has tab means inside said cap means for contacting and sealing said second orifice means in said film forming means.

10. The apparatus of claim 1 wherein said floor means contains second hole means for receipt of said dip tube means.

11. The apparatus of claim 10 wherein said dip tube means extends through said second hole means into said upper chamber means and is connected to said stem means.

12. The apparatus of claim 10 wherein flexible tube means located in said upper chamber means connects said stem means to said second hole means in said floor means.

13. The apparatus of claim 12 wherein said dip tube means is connected to said second hole means in said floor means.

14. The apparatus of claim 1 wherein said floor means has check valve means connected thereto beneath said hole in said floor means for sealing said hole when said container is inverted to prevent liquids from flowing from said container into said upper chamber means when said container is inverted.

15. The apparatus of claim 14 wherein said cap means has tabs means inside said cap means for contacting and sealing said second orifice means in said film forming means.

* * * * *